United States Patent [19]

Kutra et al.

[11] Patent Number: 4,962,597

[45] Date of Patent: Oct. 16, 1990

[54] IMPLEMENT OF AN EXCAVATING MACHINE

[76] Inventors: Sauljus I. Kutra, ulitsa Melioratorju 14, kv. 1; Ian I. Tokarev, ulitsa Tuopu, 4, kv. 16; Cheslovas V. Chinikas, ulitsa Melioratorju, 22, kv. 19; Kazimeras-Motejus K. Dokshus, ulitsa Melioratorju, 8, kv. 12; Antanas-Sigitas V. Shileika, ulitsa Nevezhio, 37, all of Litovskaya SSR, Kedainsky raion, derevnya, U.S.S.R.

[21] Appl. No.: 447,901

[22] Filed: Dec. 8, 1989

[51] Int. Cl.[5] ..... E02F 3/00

[52] U.S. Cl. ..... 37/117.5; 37/118 R; 37/141 R; 37/DIG. 3; 37/DIG. 12

[58] Field of Search ..... 37/118 R, 117.5, 141 R, 37/DIG. 3, DIG. 12, 183 R, 184, 188

[56] References Cited

U.S. PATENT DOCUMENTS

| | | | |
|---|---|---|---|
| 3,807,589 | 4/1974 | Shovick | 37/183 R X |
| 4,283,866 | 8/1981 | Ogawa | 37/117.5 |
| 4,327,509 | 5/1982 | Bean | 37/117.5 |
| 4,375,345 | 3/1983 | Hanson | 37/117.5 X |
| 4,852,277 | 8/1989 | Ward | 37/117.5 |
| 4,858,346 | 8/1989 | Schulte | 37/184 |

FOREIGN PATENT DOCUMENTS

| | | |
|---|---|---|
| 1183617 | 10/1985 | U.S.S.R. . |
| 1313960 | 5/1987 | U.S.S.R. . |

*Primary Examiner*—Dennis L. Taylor
*Assistant Examiner*—J. Russell McBee
*Attorney, Agent, or Firm*—Lilling and Lilling

[57] ABSTRACT

An implement of an excavating machine comprises a frame mounted on a boom of the machine. Secured pivotably to the frame at a common pivot are a spring-loaded knife and a bucket. A stop element is provided in the travel path of the knife to restrict its downward movement. A system for controlling the bucket acts to set the bucket to open and closed positions, in the open position of the bucket its back portion bearing on the knife which engages with the stop element, whereas in the closed position a lip of the bucket engages with a blade of the knife.

3 Claims, 3 Drawing Sheets

IMPLEMENT OF AN EXCAVATING MACHINE

FIELD OF THE INVENTION

This invention relates generally to earth-moving machines, and more particularly to an implement of an excavating machine.

The invention can be used with success for cleaning trenches of drift and growth.

The invention can also be used for preventing land slides and grading slopes.

Crop yield of drained and reclaimed land is in direct proportion with the operation of melioration systems, and therefore the water balance of the soil depends on correct operation of drain trenches, important elements of the melioration system. Proper functioning of such trenches necessitates a number of procedures among which the major one is to clean the bottoms of trenches from drift sand growth. Therefore, much effort is devoted lately to the provision on reliable equipment for thorough cleaning trench beds.

PRIOR ART

There is known an implement of an excavating machine comprising a boom, a frame secured on the boom and carrying a pivotable bucket, a hydraulic power cylinder for controlling the movement of the bucket, and a blade at the side of a bucket lip secured at the boom by a slide with a post, one end of the post being connected to the bucket by a lever, whereas the other end is connected to the bucket control cylinder (cf., SU, A, 1,183,617).

One disadvantage of this prior art implement construction resides in that rigid cooperation of the bucket lip with the blade can result in damage as rock is clamped therebetween.

There is also known an implement of an excavating machine ensuring rigid resilient cooperation of the bucket lip with the blade, whereby their damage is prevented (cf., SU, A, 1,313,960). The arrangement includes a boom, a frame secured to the boom and having a pivotable bucket, a hydraulic power cylinder for controlling the movement of the bucket, a blade pivotably connected to a slide provided on a lever, and spring for holding the blade and connected to the slide.

This construction is, however, disadvantageous due to poor quality of cleaning trench bottoms, because as the bucket is lowered to the trench and bites into the drift the blade tends to rotate in the pivots and fails to remove a slice of the drift. In addition, as the bucket closes during raising, the drift breaks away therefrom leaving the trench wall near the excavating machine not cleaned.

SUMMARY OF THE INVENTION

It is an object of the invention to improve the reliability of an implement of an excavating machine.

Another object is to provide an implement of an excavating machine capable of ensuring a more thorough cleaning trench bottoms.

The objects of the invention are attained by that in an implement of an excavating machine comprising a frame mounted on a boom of the excavating machine, a spring-loaded knife and bucket pivotably mounted on the frame, and a system for controlling the bucket for setting it in open and closed positions, in the closed position of the bucket its lip engaging with a blade of the knife, according to the invention, provided at the frame in the path of travel of the knife is a stop element acting to restrict its downward movement, the knife being arranged on one pivot with the bucket so that in the open position of the bucket its back portion bears on the knife engaging with the stop elements.

As compared with prior art implements, the proposed implement ensures more thorough cleaning of trenches thanks to that the rigid construction of the bucket and knife allows application of a higher force as they are simultaneously driven into drift at the trench bottom at the opposite sides to cut a slice of earth from the trench bottom.

In a preferred embodiment of the invention the knife has the form of parallel side members connected by a link element and carrying a blade, the blade having a ledge engagable with the bucket in its open position.

Such a construction of the knife affords, along with manufacturing simplicity, to impact a higher rigidity thereto in turn ensuring rigid locking of the knife relative to the frame in the open position of the bucket.

Preferably, the knife is spring-urged to the frame by a tension spring one end of which is secured to the link element of the knife, whereas the other end is connected to the frame.

This allows to prevent damage of the bucket lip and knife blade as solid objects are trapped therebetween, and therefore ensures a higher reliability of the bucket. In addition, thanks to the force of the tenison spring, the growth and drift clamped between the lips of the knife and bucket are reliably retained during carry-overs to result in a thorough cleaning of the trench bottom.

BRIEF DESCRIPTION OF THE DRAWINGS

Other objects and attending advantages of the present invention will become more fully apparent from a more detailed description of a specific embodiment thereof taken in conjunction with the accompanying drawings, in which.

BEST MODE OF CARRYING OUT THE INVENTION

Figure 1:
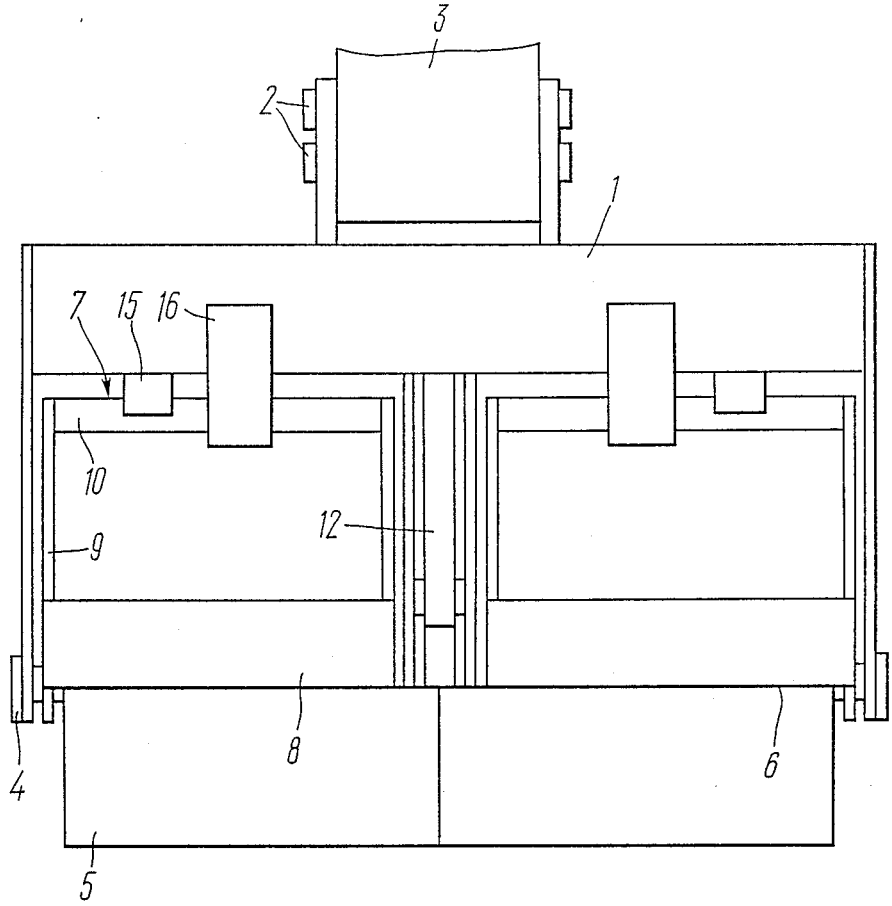
FIG. 1 is a front view of an implement of an excavating machine according to the invention in the closed position of the bucket.
Figure 2:
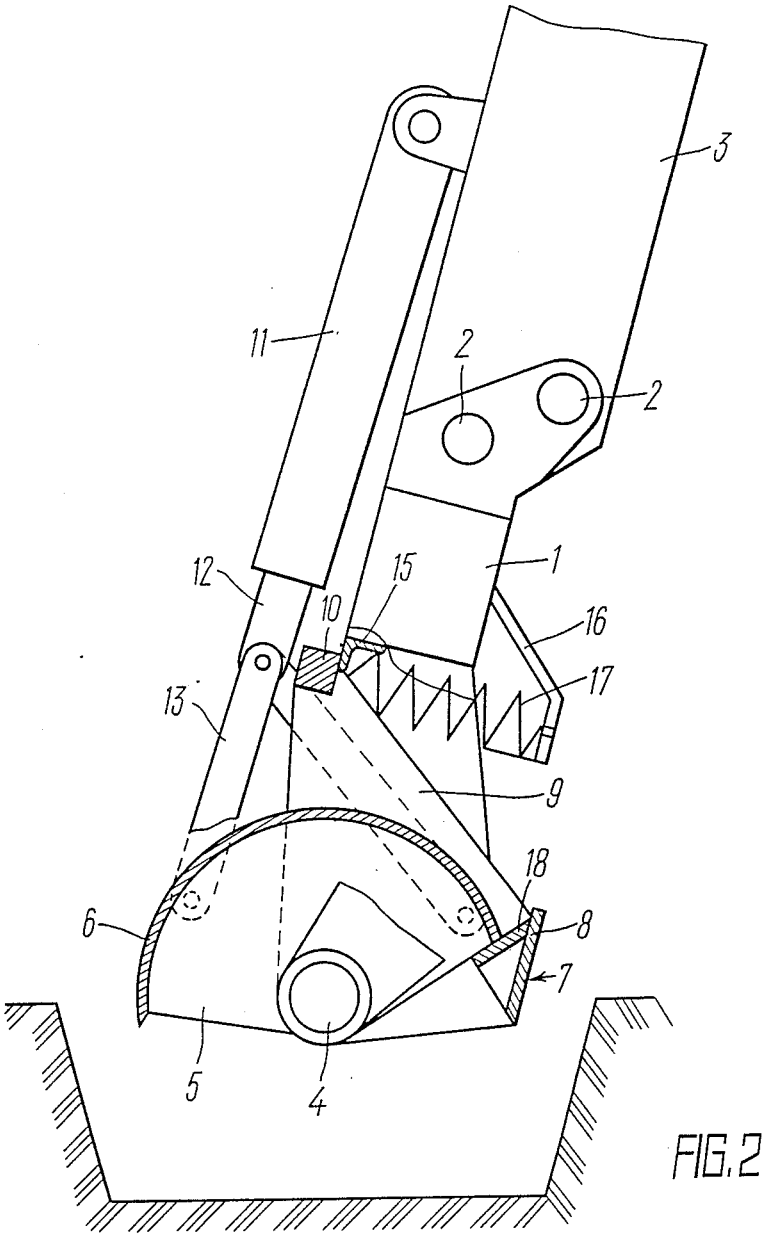
FIG. 2 is a side view of the proposed implement in the open position of the bucket.
Figure 3:
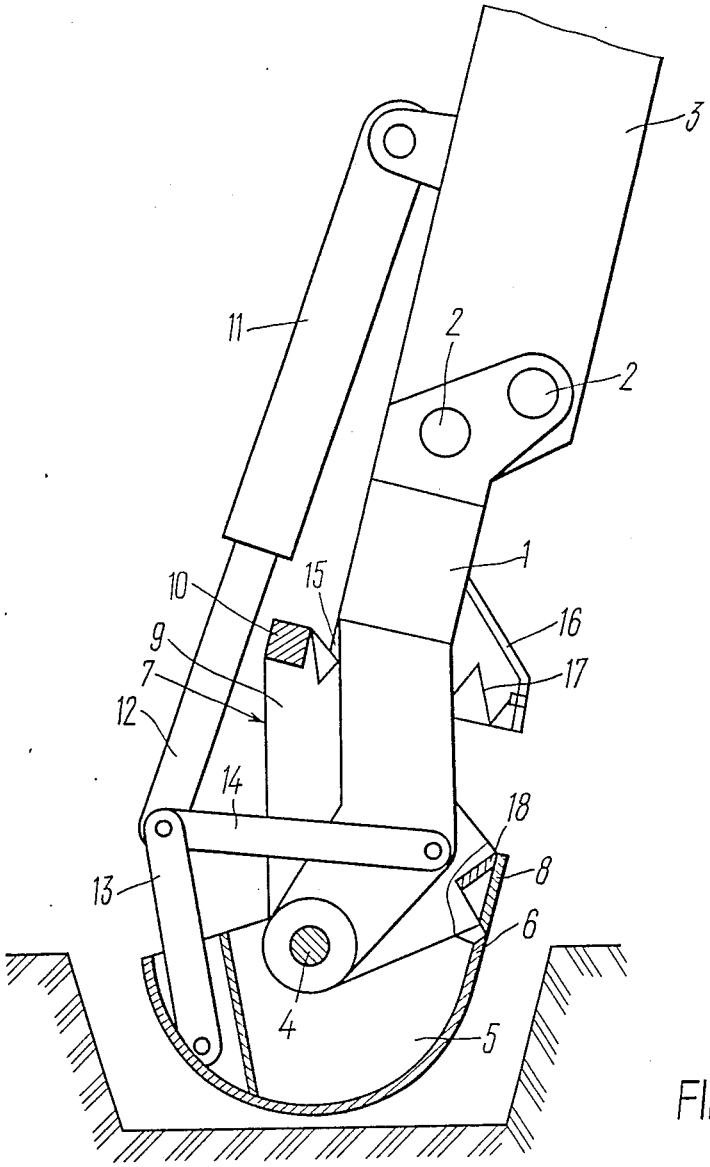
FIG. 3 is a side view of the implement in the closed position of the bucket.

Implement of an excavating machine comprises a frame 1 (FIGS. 1 to 3) connected by pins 2 to a boom 3 of the machine. Secured pivotably at the frame 1 on a pivot 4 is a bucket 5 having a lip 6. Also secured at the frame 1 on the pivot 4 is a knife 7 in the form of a rigid structure including a blade 8 attached to parallel side members 9 connected by a link 10. A system for controlling the bucket 5 comprises a hydraulic power cylinder 11 secured on the boom 3, with a rod 12 thereof connected to ties 13, 14, other ends of the ties 13, 14 being connecting to the bucket 5 and frame 1, respectively. A stop element 16 is provided at the frame 1 to restrict the downward travel path of the knife 7.

The frame 1 has brackets 16 connected to the link 10 of the knife 7 by a tension spring 17 serving to restrict the upward travel path of the knife 7.

One end of the spring 17 is secured to the link 10 of the knife 7, whereas the other end is secured to the frame 1. The blade 8 of the knife 7 is provided with a ledge 18 which cooperates with the bucket 5 in one of its positions.

The proposed implement of an excavating machine operates in the following manner.

Prior to operation the excavating machine is set at one side of a trench at a certain distance from its edge depending on the desired slope and depth of the trench.

Initially, when the rod 12 of the hydraulic power cylinder 11 is completely drawn-in, the bucket 5 is in an open position (FIG. 2) and bears by its back portion on the ledge 18 on the knife 7 which turns about the pivot 4 for the link 10 to thrust against the stop 15. In this position, as the frame 1, bucket 5 and knife 7 are rigidly fixed relative to each other, the bucket 5 is lowered to the bottom of the trench, whereas its cutting edge and blade 8 of the knife 7 bite into the ground cutting simultaneously a strip of soil at two opposite sides of the trench bottom. As the rod 12 protracts from the cylinder 11, the ties 13 and 14 act to turn the bucket 5 to a closed position (FIG. 3) whereby the lip 6 of the bucket 5 engages with the blade 8 of the knife 7. Turning of the bucket 5 ensures scooping of the drift and growth at the bottom of the trench. Rocks and other solid inclusions do not cause damage to the lip 6 of the bucket 5 or blade 8 because the knife 7 turns on the pivot 4 to raise the blade 8 enabling the bucket 5 to turn by the full stroke of the rod 12 of the hydraulic power cylinder 11. Solid matter scooped up by the bucket 5 and knife 7 is held by the springs 17 until the bucket 5 dumps its content.

What is claimed is:

1. An implement of an excavating machine comprising:

a frame mounted on a boom of the excavating machine;

a pivot secured on said frame;

a knife with a blade pivotably secured on said pivot and spring-urged thereto;

a bucket with a lip arranged at said pivot to be capable of assuming open and closed positions;

a stop element for limiting the downward travel of said knife disposed at said frame in the travel path of said knife;

a system for controlling the bucket, in the open position of the bucket its back portion bearing on said knife cooperating with said stop element; whereas in the closed position the lip of said bucket engaging with the blade of said knife.

2. An implement of an excavating machine as claimed in claim 1, in which said knife has the form of parallel side members carrying the blade of said knife, and a link element disposed between the side members, the blade of said knife haiving a ledge cooperation with said bucket in its open position.

3. An implement of an excavating machine as claimed in claim 2, in which said knife is spring-urged to said frame by a tension spring one end of which is secured to the link element of said knife and the other to said frame.

* * * * *